US010131047B2

(12) United States Patent
Yanagihara et al.

(10) Patent No.: US 10,131,047 B2
(45) Date of Patent: Nov. 20, 2018

(54) DRIVING TOOL

(71) Applicant: MAKITA CORPORATION, Anjo-Shi (JP)

(72) Inventors: Kenya Yanagihara, Anjo (JP); Ying Yang, Anjo (JP); Yoshitaka Ichikawa, Anjo (JP); Yuki Kawai, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 972 days.

(21) Appl. No.: 14/399,647

(22) PCT Filed: May 7, 2013

(86) PCT No.: PCT/JP2013/062860
§ 371 (c)(1),
(2) Date: Apr. 16, 2015

(87) PCT Pub. No.: WO2013/168718
PCT Pub. Date: Nov. 14, 2013

(65) Prior Publication Data

US 2015/0217436 A1 Aug. 6, 2015

(30) Foreign Application Priority Data

May 8, 2012 (JP) ..... 2012-107000

(51) Int. Cl.
*B25C 1/04* (2006.01)
*B25C 1/06* (2006.01)

(52) U.S. Cl.
CPC ..... *B25C 1/041* (2013.01); *B25C 1/04* (2013.01); *B25C 1/06* (2013.01); *Y10T 29/49833* (2015.01)

(58) Field of Classification Search
CPC ..... B25C 1/04; B25C 1/06
(Continued)

(56) References Cited

U.S. PATENT DOCUMENTS 1,071,387 A 8/1913 Behr
1,829,609 A 10/1931 Robinson
(Continued)

FOREIGN PATENT DOCUMENTS

JP S63229274 A 9/1988
JP H01115579 A 5/1989
(Continued)

OTHER PUBLICATIONS

Office Action dated Feb. 27, 2017 in related U.S. Appl. No. 14/391,263 and examined claims 1-20.
(Continued)

*Primary Examiner* — Michelle Lopez
(74) *Attorney, Agent, or Firm* — J-Tek Law PLLC; Jeffrey D. Tekanic; Scott T. Wakeman

(57) ABSTRACT

A driving tool, such as a nailer, includes a compression piston slidably disposed within a compression cylinder. An electric motor and a crank mechanism reciprocally drive the compression piston within the compression cylinder, and a sensor directly or indirectly detects the position of the compression piston. Prior to the start of a driving operation, a return operation is performed to move the compression piston to its bottom dead center when the sensor detects that the compression piston is located at a position other its bottom dead center.

20 Claims, 8 Drawing Sheets

(58) Field of Classification Search
USPC ..... 227/2, 130
See application file for complete search history.

(56) References Cited

U.S. PATENT DOCUMENTS

| | | | |
|---|---|---|---|
| 3,552,274 | A | 1/1971 | Bojan et al. |
| 3,602,103 | A | 8/1971 | Powers |
| 3,638,534 | A | 2/1972 | Ramspeck |
| 3,821,992 | A | 7/1974 | Matsuo |
| 3,824,898 | A | 7/1974 | Pauliukonis |
| 3,878,902 | A | 4/1975 | Matsuo |
| 3,995,703 | A | 12/1976 | Wanner |
| 4,344,555 | A | 8/1982 | Wolfberg |
| 5,193,730 | A | 3/1993 | Tanaka et al. |
| 5,605,268 | A | 2/1997 | Hayashi et al. |
| 5,772,096 | A | 6/1998 | Osuka et al. |
| 6,499,643 | B1 | 12/2002 | Hewitt |
| 6,505,767 | B2 | 1/2003 | Thieleke et al. |
| 6,604,666 | B1 | 8/2003 | Pedicini et al. |
| 6,705,503 | B1 | 3/2004 | Pedicini et al. |
| 6,755,336 | B2 | 6/2004 | Harper et al. |
| 6,971,567 | B1 | 12/2005 | Cannaliato et al. |
| 7,419,079 | B2 | 9/2008 | Chen et al. |
| 7,793,811 | B1 | 9/2010 | Pedicini et al. |
| 8,079,504 | B1 | 12/2011 | Pedicini et al. |
| 8,960,516 | B2 | 2/2015 | Iijima et al. |
| 9,276,509 | B2 | 3/2016 | Kato et al. |
| 9,438,141 | B2 | 9/2016 | Ishikawa et al. |
| 9,543,871 | B2 | 1/2017 | Kato |
| 9,555,530 | B2 | 1/2017 | Pedicini et al. |
| 2004/0232194 | A1 | 11/2004 | Pedicini et al. |
| 2005/0001004 | A1 | 1/2005 | Fujisawa et al. |
| 2005/0217874 | A1 | 10/2005 | Forster et al. |
| 2007/0045377 | A1 | 3/2007 | Towfighi |
| 2007/0138230 | A1 | 6/2007 | Gschwend et al. |
| 2008/0017689 | A1 | 1/2008 | Simonelli et al. |
| 2008/0073405 | A1 | 3/2008 | Shima et al. |
| 2008/0190988 | A1* | 8/2008 | Pedicini ..... B25C 1/04 227/130 |
| 2008/0217372 | A1 | 9/2008 | Webb |
| 2009/0090762 | A1 | 4/2009 | Leimbach et al. |
| 2009/0184148 | A1 | 7/2009 | Dittrich et al. |
| 2009/0321492 | A1 | 12/2009 | Shima et al. |
| 2010/0213235 | A1 | 8/2010 | Pedicini et al. |
| 2010/0236802 | A1 | 9/2010 | Berger et al. |
| 2010/0237124 | A1 | 9/2010 | Shima et al. |
| 2010/0237126 | A1 | 9/2010 | Matsunaga et al. |
| 2011/0108600 | A1 | 5/2011 | Pedicini et al. |
| 2011/0155403 | A1 | 6/2011 | Rohrer |
| 2011/0240709 | A1 | 10/2011 | Oouchi |
| 2012/0019177 | A1 | 1/2012 | Kaufmann et al. |
| 2012/0187178 | A1 | 7/2012 | Campbell |
| 2012/0286014 | A1 | 11/2012 | Pedicini et al. |
| 2014/0054350 | A1 | 2/2014 | Pedicini |
| 2014/0158740 | A1 | 6/2014 | Akutsu et al. |
| 2014/0318363 | A1 | 10/2014 | Bennett |
| 2014/0374461 | A1 | 12/2014 | Pedicini et al. |
| 2015/0122868 | A1 | 5/2015 | Campbell |
| 2015/0129630 | A1 | 5/2015 | Matsuno |
| 2015/0158160 | A1 | 6/2015 | Kato |
| 2015/0174748 | A1 | 6/2015 | Furuta et al. |
| 2015/0217436 | A1 | 8/2015 | Yanagihara et al. |
| 2015/0298308 | A1 | 10/2015 | Kato |
| 2015/0314432 | A1 | 11/2015 | Yang et al. |
| 2017/0001291 | A1 | 1/2017 | Schnell et al. |
| 2017/0217004 | A1 | 8/2017 | Kato |

FOREIGN PATENT DOCUMENTS

| | | | |
|---|---|---|---|
| JP | H0270980 | U | 5/1990 |
| JP | H0396751 | A | 4/1991 |
| JP | H666967 | U | 9/1994 |
| JP | H08276375 | A | 10/1996 |
| JP | 200417206 | A | 1/2004 |
| JP | 2004017206 | A | 1/2004 |
| JP | 2005028568 | A | 2/2005 |
| JP | 2008062360 | A | 3/2008 |
| JP | 2008068353 | A | 3/2008 |
| JP | 200990384 | A | 4/2009 |
| JP | 2009172762 | A | 8/2009 |
| JP | 20105776 | A | 1/2010 |
| JP | 2010173044 | A | 8/2010 |
| JP | 2011025362 | A | 2/2011 |
| JP | 2011025363 | A | 2/2011 |
| JP | 2011056613 | A | 3/2011 |
| JP | 2012148346 | A | 8/2012 |
| JP | 2012518553 | A | 8/2012 |
| JP | 2013233608 | A | 11/2013 |
| JP | 2014083601 | | 5/2014 |
| WO | 2011010511 | A1 | 1/2011 |
| WO | 2014061807 | A1 | 4/2014 |
| WO | 2014069648 | A1 | 5/2014 |

OTHER PUBLICATIONS

Final Office Action from the United States Patent Office dated Jun. 26, 2017 in related U.S. Appl. No. 14/391,263, including examined claims 1-20.

Non-final Office Action from the United States Patent Office dated May 15, 2017 in related U.S. Appl. No. 14/391,283, including examined claims 1-12 and 14-21.

English translation of International Preliminary Report on Patentability for parent application No. PCT/JP2013/062860.

English translation of International Search Report for parent application No. PCT/JP2013/062860.

Office Action from the Japanese Patent Office dated Jun. 2, 2015 in related Japanese application No. 2012-088842, and translation of substantive portions thereof.

Office Action from the Japanese Patent Office dated Jun. 2, 2015 in related Japanese application No. 2012-088843, and translation of substantive portions thereof.

Office Action dated Mar. 18, 2016 in counterpart German patent application 11 2013 002 383.0, including English translation of substantive portions thereof.

Non-final Office Action dated Sep. 5, 2017 in related U.S. Appl. No. 14/565,993, including examined claims 1-19.

Office Action from the Japanese Patent Office dated Aug. 16, 2017 in related Japanese application No. 2014-084678, and translation of substantive portions thereof.

Office Action from the Japanese Patent Office dated Feb. 3, 2016 in related Japanese application No. 2012-243442, and translation of substantive portions thereof.

Office Action from the Japanese Patent Office dated May 31, 2016 in related Japanese application No. 2012-243442, and translation of substantive portions thereof.

Office Action from the Japanese Patent Office dated Sep. 21, 2017 in related Japanese application No. 2012-243442, and translation thereof.

* cited by examiner

DRIVING TOOL

CROSS-REFERENCE

This application is the US national stage of International Patent Application No. PCT/JP2013/062860 filed on May 7, 2013, which claims priority to Japanese Patent Application No. 2012-107000 filed on May 8, 2012.

TECHNICAL FIELD

The present invention generally relates to a driving (power) tool that drives a driven article, such as a fastener, into a workpiece.

BACKGROUND ART

A driving tool that drives a driven article into a workpiece is described in U.S. Pat. No. 8,079,504. In this driving tool, compressed air generated by a first piston inside a first cylinder is supplied to a second cylinder. Furthermore, the compressed air moves a second piston within the second cylinder. When the second piston moves, the second piston strikes the driven article and thereby drives it toward the workpiece. In addition, this driving tool comprises a sensor that detects the position of the first piston in the operation cycle in which the driven article is driven. Furthermore, in accordance with the position of the first piston detected by the sensor, a control apparatus stops the flow of electric current to a motor, which causes the first piston to stop prior to the next operation cycle.

SUMMARY OF THE INVENTION

However, in the above-described driving tool, if the first piston does not stop at the prescribed position (i.e. its bottom dead center), then the compression of air in the next operation cycle will be insufficient or excessive. That is, there is a possibility that malfunctions will occur in the operation of driving the driven article.

Accordingly, an object of the present teachings is to provide, in a driving tool, a further improved technique concerning the driving operation of the driven article.

In one aspect of the present teachings, a driving tool preferably comprises: a first cylinder; a first piston slidably housed within the first cylinder; a drive mechanism that drives the first piston; a second cylinder that communicates with the first cylinder; a second piston slidably housed within the second cylinder; a valve member provided in a region in which the second cylinder communicates with the first cylinder; and a sensor that detects a position of the first piston. The first cylinder is configured to generate compressed air by the sliding of the first piston in the state in which the valve member is closed. In addition, the second piston is configured to be moved by the compressed air when the valve member is opened and the compressed air inside the first cylinder is supplied into the second cylinder. Furthermore, the driven article is configured to be driven out of the ejection port by the movement of the second piston caused by the compressed air. Furthermore, the driving tool performs a return operation that moves the first piston to its bottom dead center, prior to the start of a driving operation of the driven article, if the position of the first piston detected by the sensor is a position other than the bottom dead center of the first piston.

According to this aspect of the present teachings, because the first piston is positioned at the bottom dead center prior to the start of the driving operation, the degree of compression with which the first piston compresses the air inside the first cylinder is constant in every driving operation. Thereby, the driven articles are driven at a prescribed (constant) speed in every driving operation. This aspect of the present teachings avoids problems or malfunctions that can occur in situations in which, during a driving operation of the driven article, the drive mechanism suddenly stops due to the battery running out, the battery being disconnected, or the like, or in which the first piston does not stop at the bottom dead center due to, for example, a problem during the driving operation. In such situations, if the first piston has not stopped at the bottom dead center, the first piston is moved to the bottom dead center prior to the start of the (next) driving operation, and consequently the degree of compression with which the first piston compresses the air inside the first cylinder remains constant.

According to another aspect of to the present teachings, the drive mechanism comprises a motor and a crank member driven by the motor. The sensor detects a position in a rotational direction of a rotary shaft of the motor, a position of the crank member, or a position of the first piston.

According embodiments of this aspect, the sensor may be configured to indirectly detect the position of the first piston by measuring the position of a component in the drive mechanism. In such embodiments, there is no need to directly measure the position of the first piston. In other words, the position of the first piston can be detected or determined easily without directly measuring the position of the first piston. However, in other embodiments of this aspect, the sensor may directly measure the position of the first piston.

According to another aspect of the present teachings, the return operation is started simultaneously with the direct or indirect detection of the position of the first piston by the sensor.

According to this aspect, because the return operation is started simultaneously with the detection of the position of the first piston by the sensor, there is no need to provide a storage device (memory) or the like that stores the detected position of the first piston.

According to another aspect of the present teachings, the driving tool comprises a trigger that controls the driving operation. Furthermore, the driving tool is preferably configured to operate according to a single-shot driving mode, in which one of the driven articles is driven out of the ejection port with every single operation of the trigger, and a continuous driving mode, in which a plurality of the driven articles is driven out of the ejection port in the state in which the trigger is operated once. Prior to starting the initial driving operation in the continuous driving mode and the driving operation in the single-shot driving mode, if the position of the first piston detected by the sensor is a position other than the bottom dead center, then the return operation is performed.

According to this aspect, in the continuous driving mode, because the return operation is performed only prior to the initial driving operation, the return operation is not performed during the series of driving operations. That is, there is no need to perform the return operation with each driving operation in the continuous driving mode, and therefore successive driving operations are performed smoothly.

According to another aspect of the present teachings, a battery that drives the drive mechanism is configured in an attachable and detachable manner. Furthermore, the driving tool is configured to perform the return operation when the battery is mounted onto the driving tool.

According to this aspect, because the return operation is performed when the battery is mounted, the first piston is positioned at the bottom dead center prior to the performance of the driving operation. This aspect avoids problems in situations in which the battery runs out when the battery is disconnected, the battery is disconnected unintentionally, or the like. That is, when the battery is disconnected, there is a possibility that the first piston is not positioned at the bottom dead center. Consequently, in the present aspect, when the battery is mounted, the first piston is always moved to the bottom dead center. Thereby, the degree of compression of the air inside the first cylinder, which the first piston compresses, remains constant in every driving operation.

According to another aspect of the present teachings, in the return operation, the first piston is moved to the bottom dead center such that the air inside the first cylinder is not compressed. For example, if the first piston is positioned at a position along the way in which the drive mechanism moves the first piston from the bottom dead center to the top dead center, then the first piston is moved to the bottom dead center by driving the drive mechanism in a direction that is the reverse of the direction when the driving operation is performed. On the other hand, if the first piston is positioned at a position along the way in which the drive mechanism moves the first piston from the top dead center to the bottom dead center, then the first piston is moved to the bottom dead center by driving the drive mechanism in the same direction as the direction when the driving operation is performed.

According to this aspect, the first piston is moved to the bottom dead center without the first piston passing through its top dead center. Thereby, when the first piston is moved to the bottom dead center, the air inside the first cylinder is not compressed. Accordingly, when the first piston is moved to the bottom dead center, an unintentional driving of the driven article is prevented.

In another aspect of the present teachings, an informing (indicating) means for reporting or communicating the return operation to the user is provided. For example, a light-emitting means, a vibration-generating means, a sound-generating means, or the like is preferably used as the informing means for informing the user of the fact that the return operation is being performed. An LED, a laser radiating device, or the like are examples of the light-emitting means. A means comprising a motor and that generates vibration by the rotation of the motor is an example of the vibration-generating means. In addition, a means comprising a speaker and that outputs a stored sound source from the speaker is an example of the sound-generating means.

According to this aspect, the user is informed by the informing means that the return operation is being performed.

Accordingly, a further improved technique concerning the operation of driving a driven article is provided for a driving tool.

Other features, functions, and effects of the present teachings can be readily understood by referring to the present specification, the claims, and the attached drawings.

DETAILED DESCRIPTION

Figure 1:
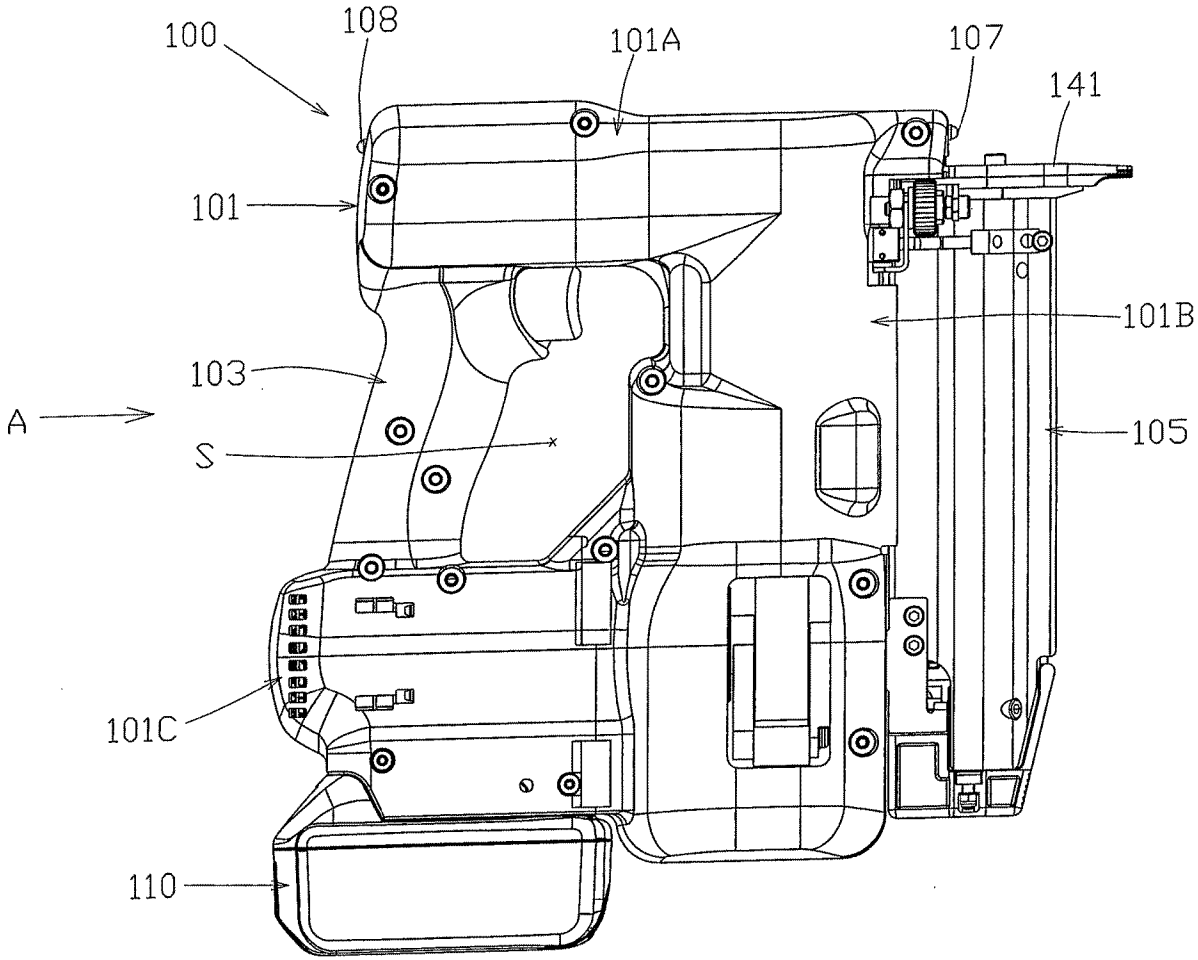
FIG. 1 is an external view that shows the overall configuration of a nailer according to the present teachings.
Figure 2:
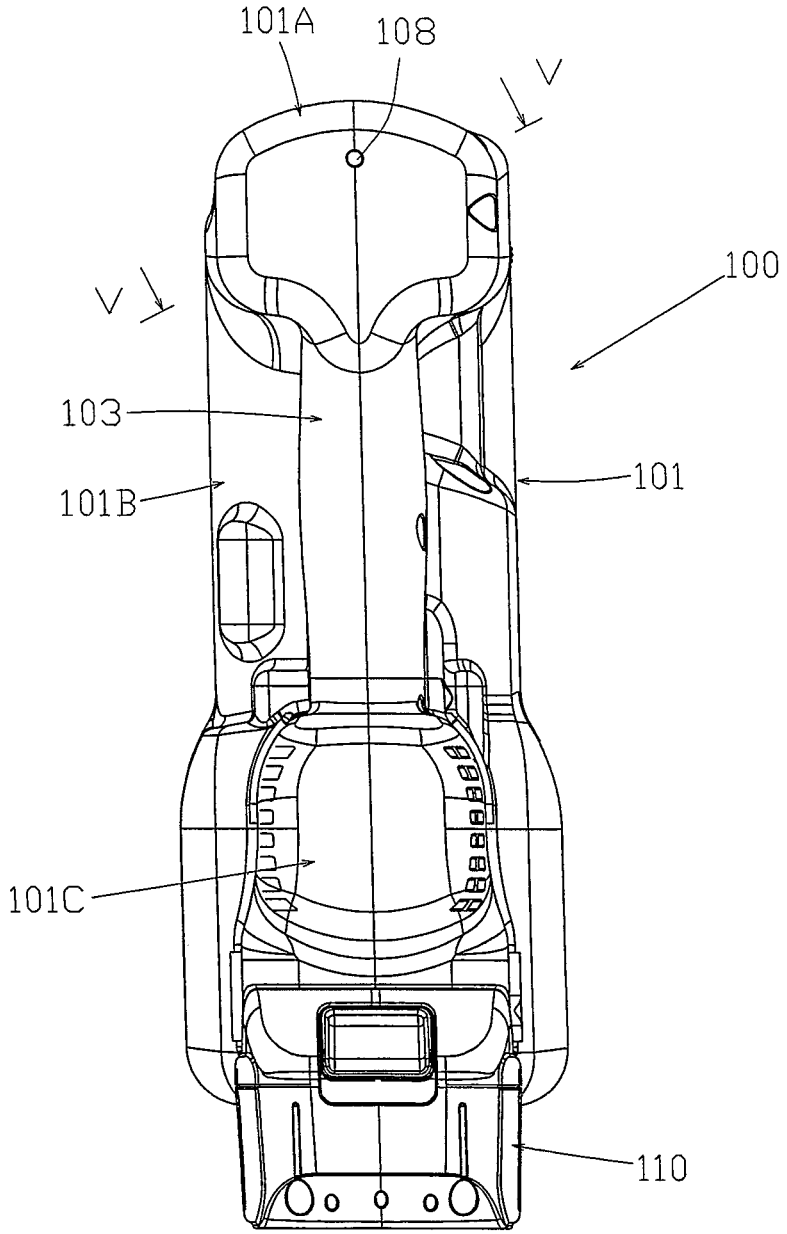
FIG. 2 is a view taken in the direction of arrow A shown in FIG. 1.

The structural elements and methods described above and below may be used separately or in conjunction with other structural elements and methods to manufacture and use driving tools according to the present teachings. Representative embodiments of this invention include these combinations and will be described in detail with reference to the attached drawings. The detailed description below merely teaches a person skilled in the art detailed information for practicing preferred examples of the present invention and does not limit the technical scope of the present invention, which is defined based on the text of the claims. Therefore, combinations of structural elements, method steps, and the like in the detailed explanation below are, in a broad sense, not all essential to practice the invention and instead merely disclose, in the detailed explanation given in conjunction with the reference numerals in the attached drawings, representative aspects of the present invention.

An embodiment will be explained below, with reference to FIG. 1 through FIG. 8. The present embodiment is explained using an electro-pneumatic nailer as one example of a driving tool. As shown in the overall views of FIG. 1 and FIG. 2, a nailer 100 principally comprises a main-body housing 101 and a magazine 105. The main-body housing 101 is defined as a tool main body and forms an outer wall of the nailer 100. The magazine 105 houses nails (not illustrated) to be driven into a workpiece. The main-body housing 101 is formed by joining together a pair of substantially symmetrical housings. The main-body housing 101 integrally comprises a handle (handle part) 103, a driving-mechanism housing part 101A, a compression-apparatus housing part 101B, and a motor-housing part 101C.

The handle part 103, the driving-mechanism housing part 101A, the compression-apparatus housing part 101B, and the motor-housing part 101C are disposed so that they substantially form a quadrangle that is defined such that these structural elements are the four sides of the quadrangle. The handle part 103 is an elongated member that extends with a prescribed length. One-end side of the handle part 103 in an extending direction in which the handle part extends is joined to one-end side of the driving-mechanism housing part 101A and the other-end side in the extending direction is joined to one-end side of the motor-housing part 101C. Moreover, the compression-apparatus housing part 101B is disposed such that it extends substantially parallel to the handle part 103, wherein one-end part (side) in an extending direction in which the compression-apparatus housing part 101B extends is joined to the other-end side of the driving-mechanism housing part 101A and the other-end side in the extending direction is joined to the other-end side of the motor-housing part 101C. Thereby, a (hollow) space S, which is surrounded by the handle part 103, the driving-mechanism housing part 101A, the compression-apparatus housing part 101B, and the motor-housing part 101C, that is substantially quadrangular in a side view of the nailer 100 is formed in the nailer 100.

As shown in FIG. 1, a driver guide 141 and an LED 107 are disposed in a tip part (the right end in FIG. 1) of the nailer 100. The rightward direction in FIG. 1 is the nail driving direction. Furthermore, for the sake of convenience of explanation, the tip side (the right side in FIG. 1) of the nailer 100 is defined as the front side or frontward, and the opposite side of the tip side of the nailer 100 (the left side in FIG. 1) is defined as the rear side or rearward. In addition, the side of the nailer 100 (the upper side in FIG. 1) to which the driving-mechanism housing part 101A of the handle part 103 is joined is defined as the upper side or upward, and the side of the nailer 100 (the lower side in FIG. 1) to which the motor-housing part 101C of the handle part 103 is joined is defined as the lower side or downward.

Figure 3:
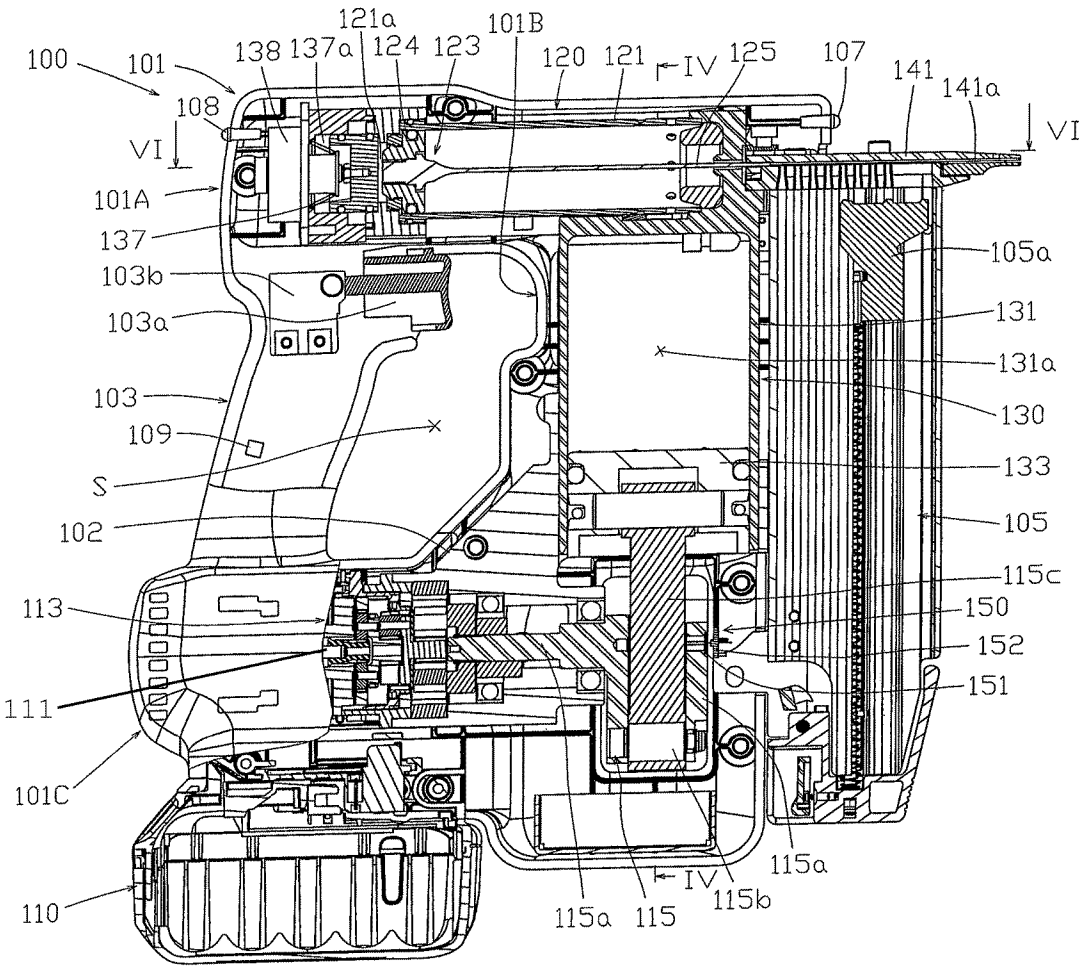
FIG. 3 is a cross-sectional view that shows the overall configuration of an internal mechanism of the nailer.

As shown in FIG. 3, the driving-mechanism housing part 101A houses a nail-driving mechanism 120. The nail-driving mechanism 120 principally comprises a driving cylinder 121 and a driving piston 123. The driving cylinder 121 and the driving piston 123 are example embodiments that correspond to a "second cylinder" and a "second piston," respectively, in the present teachings.

The driving piston 123 that drives the nails is housed, such that it is capable of sliding in the front-rear directions, in the driving cylinder 121. The driving piston 123 comprises a piston-main-body part 124 slidably housed within the driving cylinder 121 and an elongated driver 125 integrally provided with the piston-main-body part 124 and extending forward. The driving piston 123 moves linearly in the longitudinal-axis directions of the driving cylinder 121 by supplying compressed air into a cylinder chamber 121*a*. Thereby, the driver 125 is configured to move forward within a driving passage 141*a* of the driver guide 141 and drive a nail. The cylinder chamber 121*a* is formed as a space that is surrounded by an inner-wall surface of the driving cylinder 121 and a rear-side surface of the piston-main-body part 124. The driver guide 141 is disposed at a tip part of the driving cylinder 121 and comprises the driving passage 141*a*, which has a nail ejection port at its tip.

As shown in FIG. 1, the magazine 105 is disposed on the tip side of the main-body housing 101, that is, forward of the compression-apparatus housing part 101B. In addition, the magazine 105 is coupled to the driver guide 141 and configured to supply the nails to the driving passage 141*a*. That is, as shown in FIG. 3, the magazine 105 is provided with a pusher plate 105*a* for pushing the nails in a supplying direction (upward in FIG. 3). The nails are supplied, one nail at a time, by the pusher plate 105*a* to the driving passage 141*a* of the driver guide 141 from a direction that intersects the driving direction.

As shown in FIG. 3, the compression-apparatus housing part 101B houses a compression apparatus 130. The compression apparatus 130 principally comprises a compression cylinder 131, a compression piston 133, and a crank mechanism 115. The compression piston 133 is disposed, such that it is capable of sliding in the up-down directions, within the compression cylinder 131. The compression cylinder 131 and the compression piston 133 are example embodiments that correspond to a "first cylinder" and a "first piston," respectively, in the present teachings.

The compression cylinder 131 is disposed along and parallel to the magazine 105. An upper-end side of the compression cylinder 131 is joined to a front-end part of the driving cylinder 121. Furthermore, the compression piston 133 is disposed such that it slides in the up-down directions along the magazine 105. The sliding direction of the compression piston 133 is substantially orthogonal to the sliding direction of the driving piston 123. The volume of a compression chamber 131*a*, which is the internal space of the compression cylinder 131, changes as a result of the sliding of the compression piston 133 in the up-down directions. That is, the movement of the compression piston 133 toward the upward side, which reduces the volume of the compression chamber 131*a*, compresses air in the compression chamber 131*a*. The compression chamber 131*a* is formed on an upper part side that is proximate to the driving cylinder 121. In addition, the compression cylinder 131 comprises an atmosphere open valve (not illustrated). Thereby, the compression chamber 131*a* is configured such that it is capable of opening to the atmosphere. The atmosphere open valve is normally held in a closed state.

As shown in FIG. 3, the motor-housing part 101C houses an electric motor 111. The electric motor 111 is disposed such its rotational axis is substantially parallel to the longitudinal axis of the driving cylinder 121. Accordingly, the rotational axis of the electric motor 111 is orthogonal to the sliding direction of the compression piston 133. Furthermore, a battery-mounting part is formed on a lower-part side of the motor-housing part 101C, and a rechargeable battery pack 110 that supplies electric current to the electric motor 111 is attachably and detachably mounted to the battery-mounting part. The battery pack 110 is an example embodiment that corresponds to a "battery" in the present teachings.

As shown in FIG. 3, the speed of the rotary motion of the electric motor 111 is reduced by a planetary-gear-type, speed-reducing mechanism 113, after which the rotary motion is transmitted to the crank mechanism 115. Furthermore, the rotary motion of the electric motor 111 is converted into linear motion by the crank mechanism 115 and is then transmitted to the compression piston 133. The speed-reducing mechanism 113 and the crank mechanism 115 are housed within an inner-side housing 102, which is disposed over a rearward area of the compression-apparatus housing part 101B and a forward area of the motor-housing part 101C.

The crank mechanism 115 principally comprises a crankshaft 115*a*, an eccentric pin 115*b*, and a connecting rod 115*c*. The crankshaft 115*a* is joined to the planetary-gear-type, speed-reducing mechanism 113 and is rotated by the rotary motion of the electric motor 111, whose speed has been reduced by the speed-reducing mechanism 113. The eccentric pin 115*b* is provided at a position that is offset from the center of rotation of the crankshaft 115*a*. One end of the connecting rod 115*c* is pivotally joined to the eccentric pin 115*b*, and the other end of the connecting rod 115*c* is pivotally joined to the compression piston 133. The crank mechanism 115 is disposed below the compression cylinder 131. Based on the above-described configuration, the compression apparatus 130 is configured as a reciprocating-type compression apparatus and principally comprises the compression cylinder 131, the compression piston 133, and the crank mechanism 115. The combined configuration of the crank mechanism 115 and the electric motor 111 is an example embodiment that corresponds to a "drive mechanism" in the present teachings. In addition, the crankshaft 115*a* and the electric motor 111 are example embodiments that correspond to a "crank member" and a "motor," respectively, in the present teachings.

The handle part 103 is provided with a trigger 103*a*, a trigger switch 103*b*, and a control apparatus 109. Furthermore, the driving and stopping of the electric motor 111 is controlled by the control apparatus 109 in accordance with the operation of the trigger 103*a*, which is provided on the handle part 103, and the operation of the driver guide 141, which is provided at the tip area of the main-body housing 101. That is, the trigger switch 103*b* transitions to the ON state by the performance of the operation in which the trigger 103*a* is pulled. Moreover, the trigger switch 103*b* transitions to the OFF state by ceasing the pulling operation of the trigger 103*a*. Furthermore, the trigger 103*a* is disposed such that it protrudes toward the space S, which is surrounded by the handle part 103, the driving-mechanism housing part 101A, the compression-apparatus housing part 101B, and the motor-housing part 101C.

Figure 6:
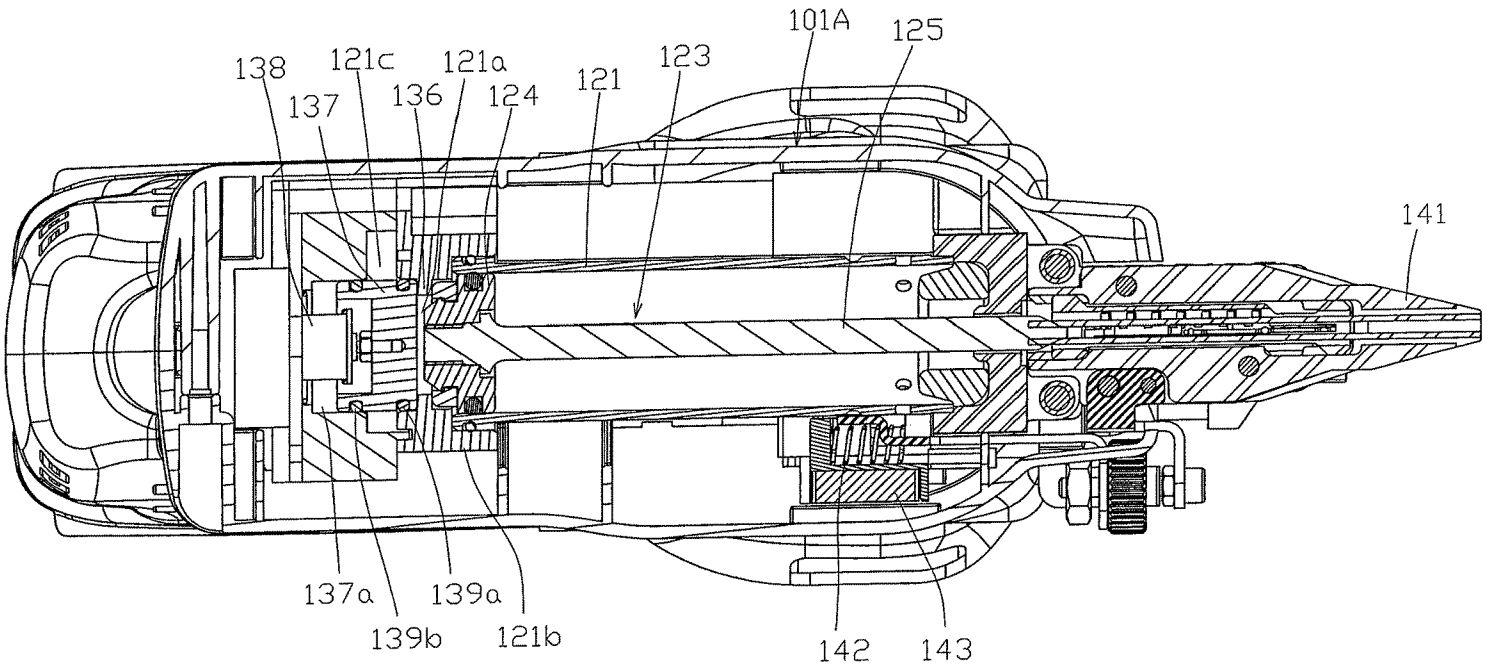
FIG. 6 is a cross-sectional view taken along line VI-VI shown in FIG. 3 and shows the state in which a valve is closed.

In addition, the driver guide 141, which serves as a contact arm, is disposed at the tip area of the main-body housing 101 such that it is capable of moving in the front-rear directions of the nailer 100. As shown in FIG. 6, the driver guide 141 is biased forward by a biasing spring 142. When the driver guide 141 is positioned forward, a contact-arm switch 143 is in the OFF state. Moreover, when the driver guide 141 moves towards the side of the main-body housing 101, the contact-arm switch 143 transitions to the ON state. Furthermore, the electric motor 111 is supplied with electric current and driven when the trigger switch 103*b* and the contact-arm switch 143 are both switched to the ON state, and the drive of the electric motor 111 is stopped when either of these switches is switched to the OFF state.

Figure 5:
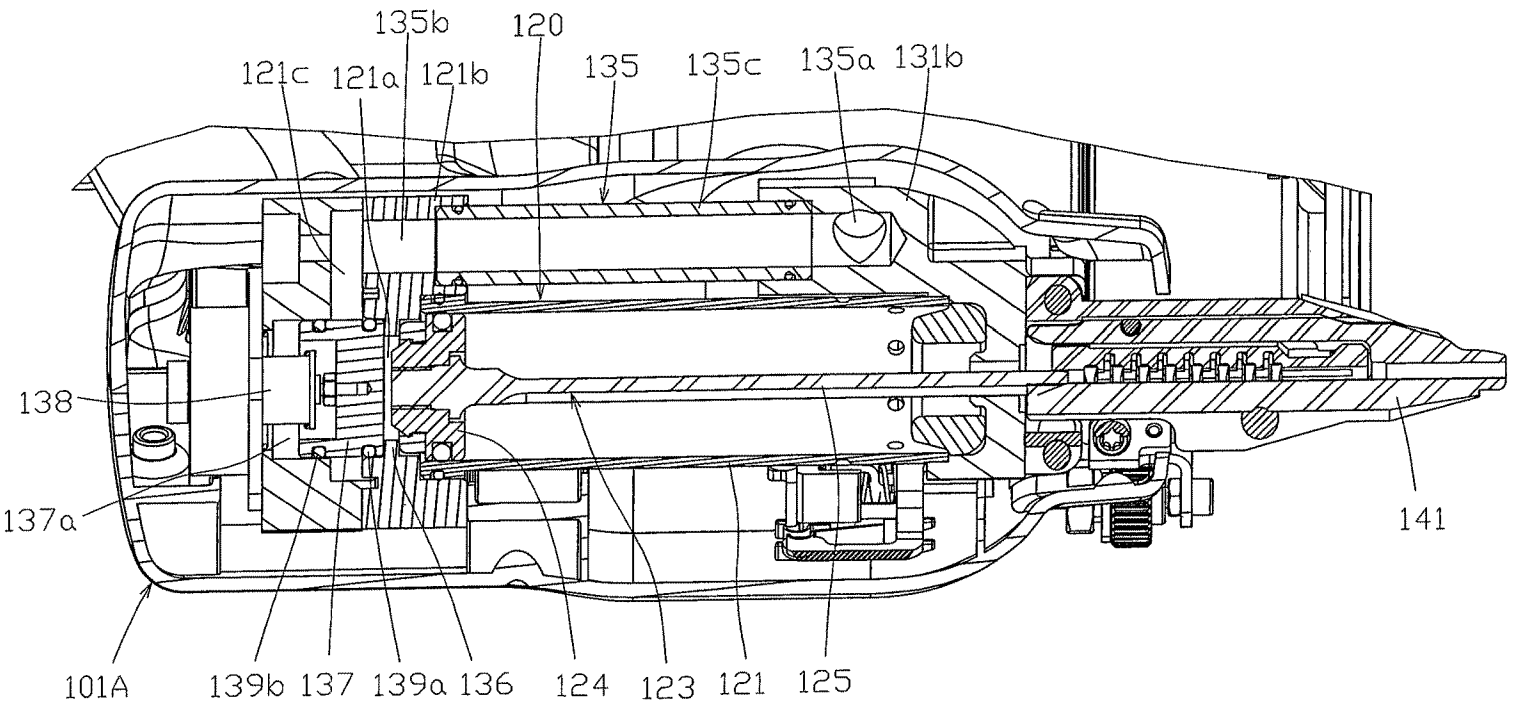
FIG. 5 is a cross-sectional view taken along line V-V shown in FIG. 2.

As shown in FIG. 5, the nailer 100 has an air passage 135 and a valve chamber 137*a* that provide communication between the compression chamber 131*a* of the compression cylinder 131 and the cylinder chamber 121*a* of the driving cylinder 121.

Figure 4:
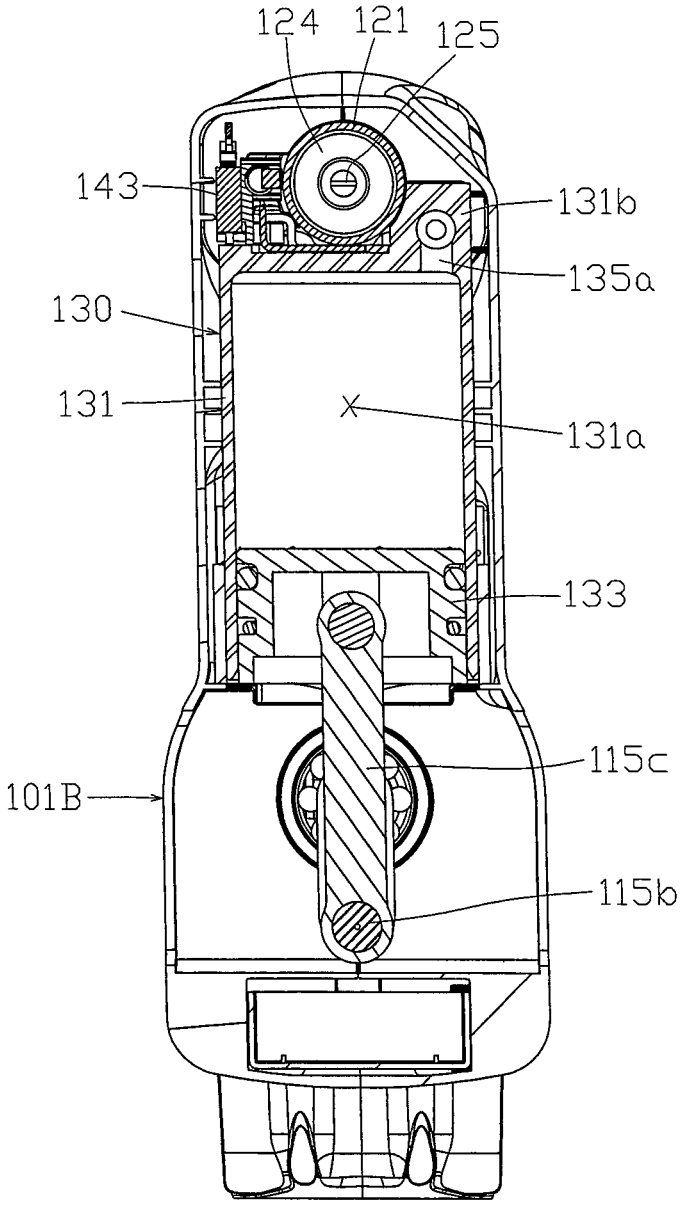
FIG. 4 is a cross-sectional view taken along line IV-IV shown in FIG. 3.

As shown in FIG. 5, the air passage 135 principally comprises a communication port 135*a*, a communication port 135*b*, a communication path 135*c*, an annular groove 121*c*, and the valve chamber 137*a*. As shown in FIG. 4, the communication port 135*a* is formed in a cylinder head 131*b* of the compression cylinder 131. The communication port 135*a* communicates with the compression chamber 131*a*. In addition, as shown in FIG. 5, the communication port 135*b* is formed in a cylinder head 121*b* of the driving cylinder 121. The communication port 135*b* communicates with the valve chamber 137*a*. The communication path 135*c* provides communication between the communication port 135*a* and the communication port 135*b*. The communication path 135*c* is formed as a pipe-shaped member and extends linearly in the front-rear direction along the driving cylinder 121.

As shown in FIG. 5, the communication port 135*b* communicates with the annular groove 121*c*, which is formed in a circumferential surface of the valve chamber 137*a*. The annular groove 121*c* communicates with the valve chamber 137*a*. Furthermore, the valve chamber 137*a* communicates with the cylinder chamber 121*a*. Thereby, the communication port 135*b* communicates with the cylinder chamber 121*a* via the annular groove 121*c* and the valve chamber 137*a*. A solenoid valve 137, which opens and closes the air passage 135, is housed in the valve chamber 137*a*. The solenoid valve 137 is an example embodiment that corresponds to a "valve member" in the present teachings.

The solenoid valve 137 is a cylindrical member having a diameter substantially the same as that of the piston-main-body part 124 of the driving piston 123. The solenoid valve 137 is disposed, such that it is capable of moving in the front-rear directions, within the valve chamber 137*a*. An electromagnet 138 is disposed rearward of the solenoid valve 137. Furthermore, the solenoid valve 137 moves in the front-rear directions by switching between the supply of electric current and the cutoff of the supply of electric current to the electromagnet 138. Two O-rings 139*a*, 139*b* are disposed on the outer circumference of the solenoid valve 137 at a prescribed spacing in the front-rear direction. The solenoid valve 137 opens and closes the annular groove 121*c* by moving rearward and forward, respectively.

Figure 7:
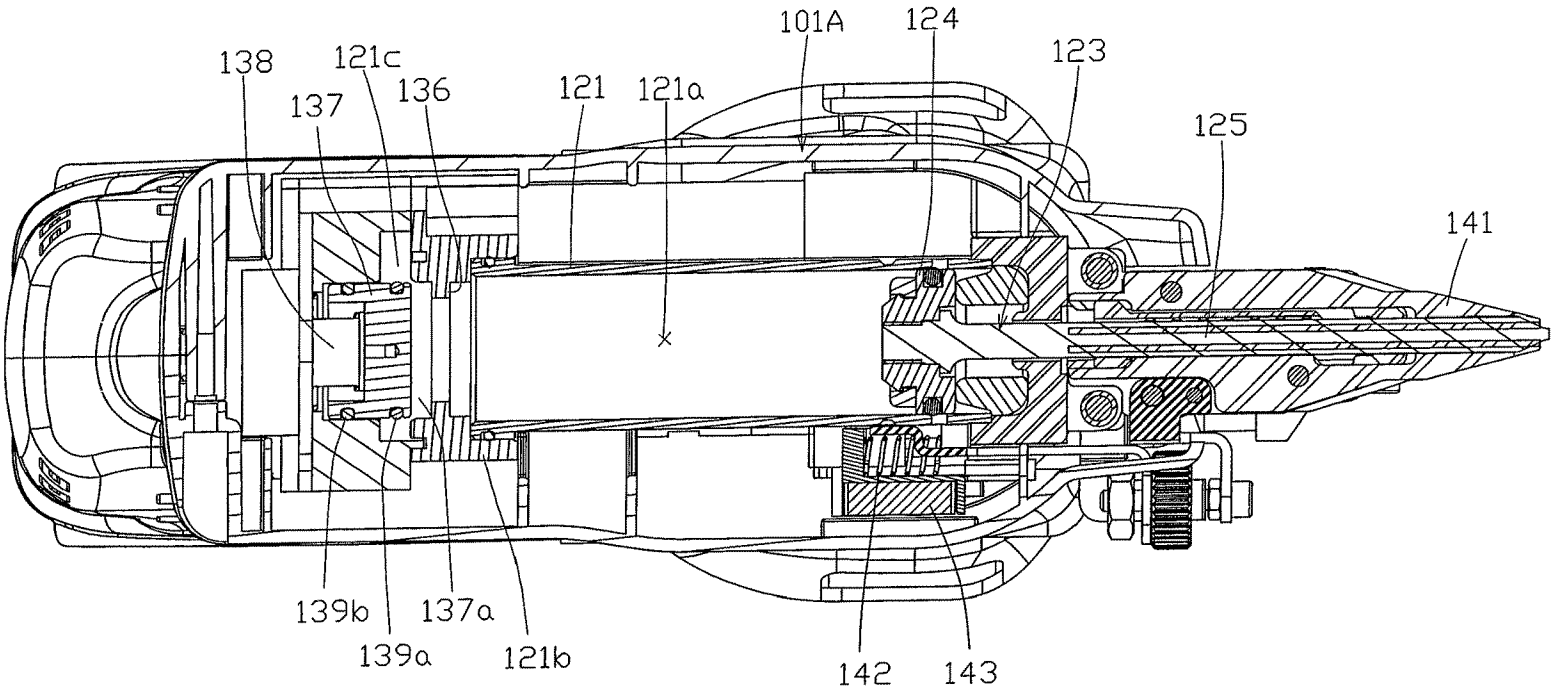
FIG. 7 shows a nailing state in which the valve in FIG. 6 has opened and the driving piston has moved forward.

Specifically, as shown in FIG. 6, the O-ring 139*a*, which is on the front side, blocks communication between the annular groove 121*c* and the cylinder chamber 121*a* as a result of contacting the inner wall surface of the valve chamber 137*a* forward of the annular groove 121*c*. In addition, as shown in FIG. 7, when the O-ring 139*a* moves into the region of the annular groove 121*c*, the annular groove 121*c* communicates with the cylinder chamber 121*a*. Furthermore, O-ring 139*b*, which is on the rear side, is for preventing the compressed air from leaking out of the communication port 135*b* and does not contribute to the opening or closing of the annular groove 121*c*. Thus, the solenoid valve 137, which opens and closes the air passage 135, is provided on the side of the air passage 135 on which the cylinder chamber 121*a* of the driving cylinder 121 is connected.

As shown in FIG. 6, the solenoid valve 137 is disposed forward by the electromagnet 138 such that the annular groove 121*c* is normally closed. In addition, a stopper 136 is disposed forward of the solenoid valve 137 and limits the forward movement of the solenoid valve 137. The stopper 136 is formed by a flange-shaped member protruding toward the center in the radial direction inside the cylinder chamber 121*a*. Furthermore, the stopper 136 defines a rear-end position of the rearward movement of the driving piston 123.

As shown in FIG. 3, in the nailer 100, the state in which the driving piston 123 is positioned at the rear-end position (the left-end position in FIG. 3) and the compression piston 133 is positioned at the lower-end position (bottom dead center) is defined as the initial position. That is, the initial state is when the crank angle is 0° (bottom dead center).

In the initial state shown in FIG. 3, when the contact-arm switch 143 (refer to FIG. 6) is set to the ON state by the driver guide 141 being pressed against the workpiece and when the trigger 103*a* is pulled and the trigger switch 103*b* switches to the ON state, the electric motor 111 is supplied with electric current and driven. Thereby, the crank mechanism 115 is driven via the speed-reducing mechanism 113, and the compression piston 133 moves upward. At this time, because the solenoid valve 137 closes the air passage 135, the air inside the compression chamber 131*a* is compressed by the movement of the compression piston 133.

When the compression piston 133 reaches an upper-end position (top dead center), which corresponds to a crank angle of 180°—that is, when the compressed air inside the compression chamber reaches the maximum compression state—the solenoid valve 137 is moved rearward by the electromagnet 138. Thereby, the annular groove 121*c* communicates with the cylinder chamber 121*a*, and the compressed air inside the compression chamber 131*a* is supplied into the cylinder chamber 121*a* via the air passage 135. When the compressed air is supplied into the cylinder chamber 121*a*, the driving piston 123 is moved forward by the action of the "air spring" produced by the compressed air, as shown in FIG. 7. Furthermore, the driver 125 of the driving piston 123, which has moved forward, strikes the nail disposed in the driving passage 141*a* of the driver guide 141. Thereby, the nail is driven out—namely, a so-called driving operation is performed—and then driven into the workpiece.

Figure 8:
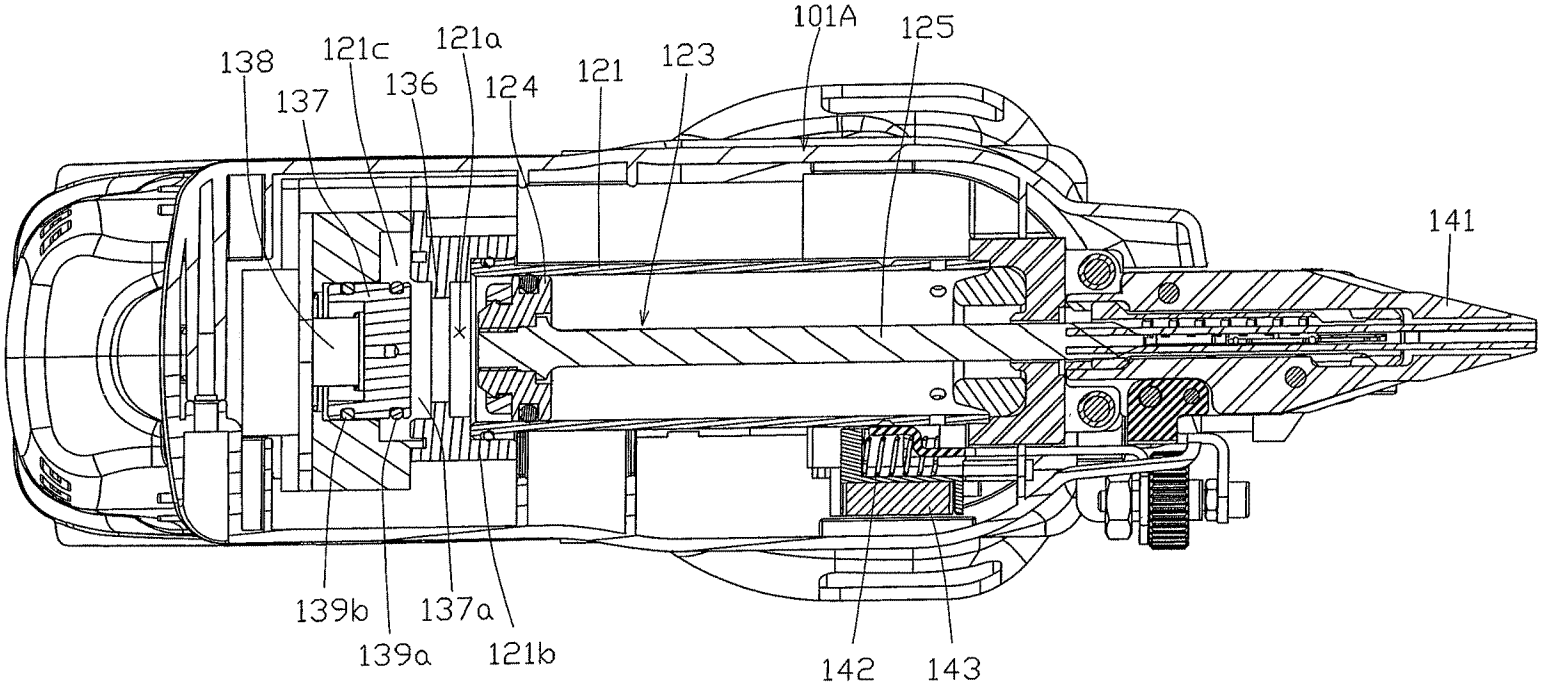
FIG. 8 shows the state in which the open state of the valve is maintained and the driving piston has returned nearly to the rearward initial position shown in FIG. 6.

After the driving operation, the compression piston 133 moves toward the bottom dead center. At this time, the volume of the compression chamber 131*a* increases and the air pressure inside the compression chamber 131*a* is reduced to a pressure lower than atmospheric pressure. The pressure inside the compression chamber 131*a* acts on the driving piston 123 via the air passage 135 and the cylinder chamber 121*a*. Thereby, as shown in FIG. 8, the driving piston 123 is suctioned and thereby moved rearward. Furthermore, the driving piston 123 makes contact with the stopper 136 and is positioned at the initial position. The solenoid valve 137 maintains the communication between the air passage 135 and the cylinder chamber 121*a* until the driving piston 123 is moved to the initial position. When the driving piston 123 is positioned at the initial position, the solenoid valve 137 moves forward and cuts off communication between the air passage 135 and the cylinder chamber 121*a*. Furthermore, when the compression piston 133 returns to the initial position, even if the trigger switch 103*b* and the contact-arm switch 143 are maintained in the ON state, the flow of current to the electric motor 111 is cut off, and thereby the drive of the electric motor 111 is stopped. Thus, one cycle of the driving operation ends. Furthermore, during the driving operation, the LED 107 illuminates (irradiates) the tip area of the driver guide 141.

During the nail-driving operation in the above-described nailer 100, the supply of electric current to the electric motor 111 might be stopped by, for example, the charge in the battery pack 110 running out, the battery pack 110 being disconnected unintentionally, or the like. In addition, there is a possibility that some other problem during a driving operation might arise. In such a case, there are situations in which the compression piston 133 does not come to a stop at the bottom dead center. If the compression piston 133 is not stopped at the bottom dead center, then, when the driving operation restarts, the degree of compression of the compressed air generated by the compression piston 133 will differ in accordance with the position of the compression piston 133 at the time that the driving operation was started. Consequently, the speed with which the nails are driven out in each driving operation will not be constant, and the extent to which the nails are driven into the workpiece will vary in an adverse manner. Consequently, if the compression piston 133 is not positioned at the bottom dead center prior to the performance of a driving operation, then a return operation is performed that moves the compression piston 133 to the bottom dead center. Furthermore, the return operation is performed in the state in which the atmosphere open valve formed in the compression cylinder 131 is open and the compression chamber 131*a* is open to the atmosphere.

Specifically, as shown in FIG. 3, the nailer 100 comprises a magnetic sensor 150. The magnetic sensor 150 principally comprises a magnet 151 and a Hall-effect device 152. The magnet 151 is provided on the crankshaft 115*a*. Moreover, the Hall-effect device 152 is provided at a position of the compression-apparatus housing part 101B opposing the magnet 151. The Hall-effect device 152 is electrically connected to the battery pack 110 and furthermore is connected to the control apparatus 109. The magnetic sensor 150 is an example embodiment that corresponds to a "sensor" in the present teachings.

Prior to the performance of the driving operation, the magnetic sensor 150 measures the position of the crankshaft 115*a* based on the Hall effect that arises in the Hall-effect device 152 due to the magnetic field of the magnet 151. That is, because the magnetic-flux density varies with the position of the magnet 151, the control apparatus 109 measures the position of the crankshaft 115*a* based on the output voltage of the Hall-effect device 152, which corresponds to the magnetic-flux density. Thereby, the position of the compression piston 133, which is joined to the crankshaft 115*a*, is detected.

The timing at which the magnetic sensor 150 detects the position of the compression piston 133 is prior to the performance of the driving operation. Specifically, the magnetic sensor 150 measures the position of the crankshaft 115*a* at each of the timings below.

Timing 1: When the battery pack 110 is mounted on the battery-mounting part Timing 2: When the trigger 103*a* is operated Timing 3: When the driver guide 141 is pressed against the workpiece The magnetic sensor 150 measures the position of the crankshaft 115*a* at at least one timing of the Timings 1-3. That is, the magnetic sensor 150 measures the position of the crankshaft 115*a* at a timing selected from among the Timings 1-3. The timing at which the magnetic sensor 150 measures the position of the crankshaft 115*a* is preset in the control apparatus 109.

For example, during the operation of driving a driven article, there are situations in which the compression piston 133 adversely stops at a position other than the bottom dead center owing to the charge of the battery pack 110 running out, the unintentional disconnection of the battery pack 110, or the like. Accordingly, at Timing 1, the position of the compression piston 133 is detected by the measurement of the position of the crankshaft 115*a* by the magnetic sensor 150. Furthermore, if the compression piston 133 is positioned at a position other than the bottom dead center, then the control apparatus 109 drives the electric motor 111 to move the compression piston 133 to the bottom dead center.

Moreover, the nailer 100 is configured such that, when one driving operation ends, the compression piston 133 moves from the top dead center to the bottom dead center and stops at the bottom dead center. Nevertheless, there are cases wherein the compression piston 133 does not stop precisely at the bottom dead center owing to the inertial forces that arise because of the movement of the compression piston 133. In addition, if the operation of the trigger 103*a* stops or if the pressing of the driver guide 141 against the workpiece is released after the start of the driving operation, then the compression piston 133 will be stopped partway through the driving operation. Then, when the user operates the trigger 103*a* in an attempt to start the driving operation at Timing 2, the magnetic sensor 150 measures the position of the crankshaft 115*a*. In this case, the magnetic sensor 150 may measure the position of the crankshaft 115*a* not at Timing 2 but rather at Timing 3. By measuring the position of the crankshaft 115*a*, the position of the compression piston 133 is detected. Furthermore, if the compression piston 133 is positioned at a position other than the bottom dead center, then the control apparatus 109 drives the electric motor 111 to move the compression piston 133 to the bottom dead center.

In addition, in the nailer 100, there are situations in which a "continuous driving operation" is performed, wherein multiple nails are successively driven at discretionary time intervals. That is, a continuous driving operation is performed by ceasing, after one driving operation, the pressing of the driver guide 141 against the workpiece, with the trigger 103*a* in the pulled state and then performing the next nail-driving operation by once again pressing the driver guide 141 against another portion of the workpiece. In other words, in a normal driving operation, one nail is driven out for each single operation of the trigger 103*a*; however, in a continuous driving operation, multiple nails are driven out in the state in which the trigger 103*a* is operated one time. In a continuous driving operation, when the user operates the trigger 103*a* in an initial attempt to start the driving operation at Timing 2, the magnetic sensor 150 measures the position of the crankshaft 115*a*. Accordingly, the magnetic sensor 150 measures the position of the crankshaft 115*a* only prior to the start of the initial driving operation from among the plurality of driving operations. Furthermore, if a continuous driving operation is performed, the magnetic sensor 150 may measure the position of the crankshaft 115*a* at Timing 3, which is when the driver guide 141 is pressed against the workpiece prior to each driving operation. In addition, in the continuous driving operation, the magnetic sensor 150 may measure the position of the crankshaft 115*a* at Timing 2 and at Timing 3. The position of the compression piston 133 is detected by measuring of position of the crankshaft 115*a*. Furthermore, if the compression piston 133 is positioned at a position other than the bottom dead center, then the control apparatus 109 drives the electric motor 111 to move the compression piston 133 to the bottom dead center.

In the return operation that moves the compression piston 133 to the bottom dead center, the control apparatus 109 moves the compression piston 133 such that the air inside the compression chamber 131*a* is not compressed. That is, the compression piston 133 moves to the bottom dead center without passing through the top dead center.

Specifically, if the magnetic sensor 150 measures that the crankshaft 115*a* is positioned at a crank angle between 0° and 180°, in other words, if the magnetic sensor 150 detects that the compression piston 133 is positioned at a position partway along the way from the bottom dead center toward the top dead center during a driving operation, then the control apparatus 109 rotates the electric motor 111 in reverse to move the compression piston 133 to the bottom dead center.

On the other hand, if the magnetic sensor 150 measures that the crankshaft 115*a* is positioned at a crank angle between 180° and 360°, in other words, if the magnetic sensor 150 detects that the compression piston 133 is positioned at a position partway along the way from the top dead center toward the bottom dead center during a driving operation, then the control apparatus 109 rotates the electric motor 111 forward to move the compression piston 133 to the bottom dead center. As a result of the electric motor 111 being controlled as described above, the compression piston 133 is moved to the bottom dead center without passing through the top dead center.

The above return operation comprises, in a selectable manner, a first return operation, which moves the compression piston 133 to the bottom dead center in one go, and a second return operation, which intermittently moves the compression piston 133 as the compression piston 133 is being moved to the bottom dead center. That is, in the first return operation, the compression piston 133 accelerates, then moves at a constant speed, and then decelerates and stops at the bottom dead center. On the other hand, in the second return operation, the compression piston 133 repetitively undergoes constant-speed movement and stopping, and finally is stopped at the bottom dead center. Accordingly, in the second return operation, the compression piston 133 is moved intermittently.

When the user starts the driving operation, if it is detected that the compression piston 133 is positioned other than at the bottom dead center, then the compression piston 133 is moved to the bottom dead center by the first return operation. That is, the return operation at Timing 2 or Timing 3 is performed by the first return operation. When the user starts the driving operation, it is necessary to quickly move the compression piston 133 to the bottom dead center, and therefore it is logical that the compression piston 133 is moved to the bottom dead center by the first return operation.

On the other hand, when the battery pack 110 is mounted, if it is detected that the compression piston 133 is positioned other than at the bottom dead center, then the compression piston 133 is moved to the bottom dead center by the second return operation. That is, the return operation at Timing 1 is performed by the second return operation. It is unknown whether the user will immediately start the driving operation merely from the fact that the battery pack 110 has been mounted. Consequently, when the battery pack 110 is mounted, the return operation is performed by the compression piston 133 being moved to the bottom dead center by the second return operation. Thereby, the fact that the return operation is being performed is communicated to the user by the vibrations generated by the intermittent movement of the compression piston 133. The second return operation is an example embodiment that corresponds to an "informing means" in the present teachings.

In addition, the LED 107 illuminates (irradiates) the tip area of the driver guide 141 during the driving operation. Moreover, the control apparatus 109 flashes the LED 107 ON and OFF during return operations. Thereby, the fact that a return operation is being performed is communicated to the user. Furthermore, it is not limited to configurations in which the LED 107 is flashed and may be configured such that the color of the light radiated by the LED 107 differs for the driving operation and the return operation. The LED 107 is an example embodiment that corresponds to the "informing/indicating means" in the present embodiment.

According to the present embodiment, the compression piston 133 is moved to the bottom dead center prior to the start of each driving operation, and consequently the degree of compression of the air compressed by the compression piston 133 can be made constant in every driving operation. Thereby, every driven article can be driven at a prescribed speed in every driving operation.

In addition, according to the present embodiment, the magnetic sensor 150 does not need to directly measure the compression piston 133. That is, there is no need to directly measure the position of a member surrounded by, for example, the compression cylinder 131, such as the compression piston 133. Accordingly, the position of the compression piston 133 can be easily detected by measuring the position of the crankshaft 115*a*, the motor shaft of the electric motor 111, or the like.

In addition, according to the present embodiment, when the battery pack 110 is mounted, the return operation is performed, and consequently the compression piston 133 can be positioned at the bottom dead center prior to the performance of the driving operation. As was noted above, there are situations in which a charge cut-off of the battery pack 110 occurs when the battery pack 110 is disconnected, the battery pack 110 is disconnected unintentionally, or the like. Even in such situations, when the battery pack 110 is mounted, the compression piston 133 can always be moved to the bottom dead center.

In addition, according to the present embodiment, the compression piston 133 can be moved to the bottom dead center without passing through the top dead center. Thereby, the air inside the compression cylinder 131 is not compressed when the compression piston 133 is moved during a return operation. Accordingly, an unintentional driving of a nail can be prevented when the compression piston 133 is being moved.

In addition, according to the present embodiment, the LED 107, the second return operation of the return operations, and the like, which are the informing means, are provided, and consequently the fact that the return operation is being performed can be communicated to the user.

In the embodiment above, although the solenoid valve 137 is used as the valve member for opening and closing the air passage 135, a mechanical valve that operates mechanically may be used.

In addition, in the present embodiment, the second return operation is configured to intermittently move the compression piston 133, but it is not limited to intermittent movement of the compression piston 133 as long as the second return operation differs from the first return operation. For example, the second return operation may be configured such that the compression piston 133 repetitively accelerates and decelerates as it moves to the bottom dead center.

In addition, in the present embodiment, the fact that the return operation is being performed is communicated to the user by vibrations generated by the intermittent movement of the compression piston 133 in the second return operation, by the illumination (radiation) of light by the LED 107, or the like, but the present embodiment is not limited thereto. For example, the fact that the return operation is being performed may be communicated to the user by the illumination (radiation) of light by an LED 108 provided at the rear of the nailer 100. In addition, as the informing means, the nailer 100 may be equipped with a sound-source-generating apparatus comprising a speaker.

In addition, in the present embodiment, the magnetic sensor 150 is configured to measure the position of the crankshaft 115*a* when the battery pack 110 is mounted, when the trigger 103*a* and the driver guide 141 are operated, and the like, but the present embodiment is not limited thereto. For example, a user-operatable reset switch may be provided and the timing at which the position of the crankshaft 115*a* is measured may be set to the timing at which the reset switch is operated.

In addition, in the present embodiment, the magnetic sensor 150 measures the position of the crankshaft 115*a*, but the present embodiment is not limited thereto. For example, the magnet 151 may be attached to the motor shaft of the electric motor 111, and the magnetic sensor 150 may detect the position of the compression piston 133 by measuring the rotational position of that motor shaft. In addition, the magnetic sensor 150 may be configured to measure the position of the compression piston 133. In addition, instead of a magnetic sensor, a photointerrupter that comprises a light-receiving part and a light-emitting part and the like may be used as the sensor.

In addition, in the present embodiment, the compression piston 133 is moved to the bottom dead center simultaneously with the detection of the position of the compression piston 133 by the magnetic sensor 150, but the present embodiment is not limited thereto. For example, a configuration may be utilized such that when the battery pack 110 is mounted, when a prescribed time has elapsed since the end of a driving operation, or the like, the magnetic sensor 150 detects the position of the compression piston 133 in advance, and the compression piston 133 is moved to the bottom dead center when the user operates the trigger 103*a* in an attempt to start the driving operation. In this case, the nailer 100 preferably comprises a storage device (memory) that stores the position of the compression piston 133.

Furthermore, the present embodiment explained the nailer 100 as an example of the driving tool, but the present embodiment may be applied to driving tools other than a nailer, such as those called a tacker or a stapler. In addition, the driving tool is not limited to a tool to which the battery pack 110 is mounted and may be a tool to which electric power is supplied via a power supply cord. In addition, an engine, or the like, other than the electric motor 111 may be used as the drive mechanism.

Taking into consideration the above objects of the present teachings, the following aspects of the driving tool according to the present teachings can be configured.

(Aspect 1)

A driving tool that drives a driven article out of an ejection port, comprising:

- a first cylinder;
- a first piston slidably housed within the first cylinder;
- a drive mechanism that drives the first piston;
- a second cylinder that communicates with the first cylinder;
- a second piston slidably housed within the second cylinder;
- a valve member provided in a region in which the second cylinder communicates with the first cylinder;
- a sensor that detects a position of the first piston; and
- a control apparatus that controls the drive mechanism based on a detection result of the sensor;

wherein,

- the first cylinder is configured to generate compressed air by the sliding of the first piston in the state in which the valve member is closed;
- the second piston is configured to be moved by the compressed air as a result of the valve member being opened and the compressed air inside the first cylinder being supplied into the second cylinder;
- the driven article is configured to be driven out of the ejection port by the movement of the second piston by the compressed air; and
- the control apparatus is configured such that, prior to the start of a driving operation of the driven article, if the position of the first piston detected by the sensor is a position other than bottom dead center of the first piston, then the control apparatus controls the drive mechanism so as to perform a return operation that moves the first piston to the bottom dead center.

(Aspect 2)

The driving tool according to aspect 1, wherein

- the drive mechanism comprises a motor and a crank member driven by the motor; and
- the sensor is configured to detect a position in a rotational direction of a rotary shaft of the motor, a position of the crank member, or a position of the first piston.

(Aspect 3)

The driving tool according to aspect 1 or 2, wherein

- the control apparatus is configured to control the drive mechanism so as to start the return operation simultaneously with the detection of the position of the first piston by the sensor.

(Aspect 4)

The driving tool according to any one of aspects 1-3, comprising:

- a trigger that controls the driving operation;

wherein,

- the control apparatus has a single-shot driving mode, in which one of the driven articles is driven out of the ejection port with every single operation of the trigger, and a continuous driving mode, in which a plurality of the driven articles is driven out of the ejection port in the state in which the trigger is operated once; and the control apparatus is configured such that, prior to starting the initial driving operation in the continuous driving mode and the driving operation in the single driving mode, if the position of the first piston detected by the sensor is a position other than the bottom dead center, then the control apparatus controls the drive mechanism so as to perform the return operation.

(Aspect 5)

The driving tool according to any one of aspects 1-4, comprising a battery-mounting part to which a battery for driving the drive mechanism is attachably and detachably mounted;

wherein, the control apparatus is configured such that, when the battery is mounted to the battery mounting part, the control apparatus controls the drive mechanism so as to perform the return operation.

(Aspect 6)

The driving tool according to any one of aspects 1-5, wherein the control apparatus is configured such that, in the return operation, the control apparatus controls the drive mechanism so as to move the first piston to the bottom dead center such that the air inside the first cylinder is not compressed.

(Aspect 7)

The driving tool according to aspect 6, wherein the control apparatus is configured such that, if the sensor detects that the first piston is positioned at a position along the way to top dead center between the bottom dead center and the top dead center, then the control apparatus performs control so that the drive mechanism operates in a direction that is the reverse of that of the driving operation to move the first piston to the bottom dead center.

(Aspect 8)

The driving tool according to any one of aspects 1-7, comprising:

an informing means for reporting the return operation.

(Aspect 9)

The driving tool according to claim 1, wherein the return operation has a first return operation, which moves the first piston to the bottom dead center in one go, and a second return operation, which intermittently moves the first piston as it moves to the bottom dead center.

(Aspect 10)

The driving tool according to claim 7, wherein the drive mechanism comprises a motor;

if the sensor detects that the first piston is positioned at a position along the way to the top dead center between the bottom dead center and the top dead center, then the motor is rotated in reverse to move the first piston to the bottom dead center.

(Aspect 11)

The driving tool according to the tenth aspect, wherein if the sensor detects that the first cylinder is positioned at a position along the way to the bottom dead center between the bottom dead center and the top dead center, then the motor rotates forward and moves the first cylinder to the bottom dead center.

(Aspect 12)

The driving tool according to claim 8, wherein the informing means is a light-emitting means.

(Aspect 13)

The driving tool according to aspect 12, wherein when the driven article is driven, the light-emitting means radiates light in a first irradiating mode that irradiates an area in which the driven article is driven; and when the return operation is performed, the light-emitting means radiates light in a second irradiating mode that is different from the first irradiating mode.

(Aspect 14)

The driving tool according to claim 8, wherein the informing means is a vibration-generating means that vibrates the driving tool.

EXPLANATION OF THE REFERENCE NUMBERS

100 Nailer
101 Main-body housing
101A Driving-mechanism housing part
101B Compression-apparatus housing part
101C Motor-housing part
102 Inner-side housing
103 Handle part
103*a* Trigger
103*b* Trigger switch
105 Magazine
105*a* Pusher plate
107 LED
108 LED
109 Control apparatus
110 Battery pack
111 Electric motor
113 Planetary-gear-type, speed-reducing mechanism
115 Crank mechanism
115*a* Crankshaft
115*b* Eccentric pin
115*c* Connecting rod
120 Nail-driving mechanism
121 Driving cylinder
121*a* Cylinder chamber
121*b* Cylinder head
121*c* Annular groove
123 Driving piston
124 Piston-main-body part
125 Driver
130 Compression apparatus
131 Compression cylinder
131*a* Compression chamber
131*b* Cylinder head
133 Compression piston
135 Air passage
135*a* Communication port
135*b* Communication port
135*c* Communication path
136 Stopper
137 Solenoid valve
137*a* Valve chamber
138 Electromagnet
139*a* O-ring
139*b* O-ring
141 Driver guide
141*a* Driving passage
142 Biasing spring
143 Contact-arm switch

150 Magnetic sensor
151 Magnet
152 Hall-effect device

The invention claimed is:

1. A driving tool configured to drive a driven article out of an ejection port, comprising:

a first cylinder;

a first piston slidably housed within the first cylinder;

a drive mechanism configured to reciprocally move the first piston in the first cylinder between a bottom dead center and a top dead center;

a second cylinder in fluid communication with the first cylinder via a fluid communication path;

a second piston slidably housed within the second cylinder;

a valve member movably disposed in the fluid communication path and configured to selectively block and permit fluid communication between the second cylinder and the first cylinder; and a sensor configured to directly or indirectly detect a position of the first piston;

wherein, the first cylinder is configured to generate compressed air by sliding of the first piston towards its top dead center when the valve member is blocking fluid communication between the second cylinder and the first cylinder;

the second piston is configured to be moved by the compressed air when the valve member is opened and the compressed air inside the first cylinder is supplied into the second cylinder and to thereby forcibly drive the driven article out of the ejection port;

and in response to the sensor directly or indirectly detecting that the first piston is stopped at a location that is not its top dead center and that is not its bottom dead center, the driving tool is configured to perform a return operation that moves the first piston to its bottom dead center.

2. The driving tool according to claim 1, wherein the drive mechanism comprises a motor and a crank member driven by the motor; and the sensor is configured to directly detect a rotational position of a rotary shaft of the motor, to directly detect a rotational position of the crank member, or to directly detect the position of the first piston.

3. The driving tool according to claim 1, wherein the driving tool is configured to start the return operation simultaneously with the direct or indirect detection of the position of the first piston by the sensor.

4. The driving tool according to claim 1, further comprising:

a trigger configured to control operation of the drive mechanism;

wherein the driving tool is further configured to:

operate according to a single-shot driving mode, in which one of the driven articles is driven out of the ejection port with every single operation of the trigger, and according to a continuous driving mode, in which a plurality of the driven articles is driven out of the ejection port in the state in which the trigger is operated once, and perform the return operation, prior to starting the initial driving operation in the continuous driving mode and prior to starting the driving operation in the single-shot driving mode, when the sensor directly or indirectly detects that the first piston is not located at its bottom dead center.

5. The driving tool according to claim 1, further comprising:

a detachable battery pack configured to supply energy for driving the drive mechanism; and the driving tool is configured to perform the return operation when the battery pack is mounted onto a battery-mounting part of the driving tool.

6. The driving tool according to claim 1, wherein the driving tool is configured, in the return operation, to move the first piston to its bottom dead center such that air inside the first cylinder is not compressed.

7. The driving tool according to claim 6, wherein the driving tool is configured to drive the drive mechanism in a reverse direction to move the first piston to its bottom dead center when the sensor directly or indirectly detects that the first piston has moved past its bottom dead center and is located on its way to its top dead center so that the first piston does not pass through its top dead center during the return operation.

8. The driving tool according to claim 1, further comprising:

an informing means for communicating to a user that the return operation is being performed.

9. An electro-pneumatic driving tool, comprising:

a first piston movably disposed within a first cylinder and configured to generate compressed air within the first cylinder when the first piston moves from a bottom dead center to a top dead center;

a second piston movably disposed within a second cylinder and configured to forcibly eject a fastener from an ejection port when the second piston moves from its bottom dead center to its top dead center as a result of the compressed air from the first cylinder being supplied into the second cylinder;

a sensor configured to output a signal representative of a position of the first piston; and a controller configured to:

determine whether the first piston has come to a stop at its bottom dead center, after the fastener has been ejected, based upon the signal received from the sensor, and in response to a determination that the first piston has come to a stop at a position that is not its top dead center and that is not its bottom dead center, cause the first piston to be moved to its bottom dead center.

10. The electro-pneumatic driving tool according to claim 9, further comprising:

a motor having a rotary shaft and a crankshaft rotatably driven by the rotary shaft and operably coupled to the first piston to reciprocally move the first piston within the first cylinder; and wherein the sensor is configured to directly detect a rotational position of the rotary shaft or of the crankshaft to generate the signal representative of the position of the first piston.

11. The electro-pneumatic driving tool according to claim 10, wherein the controller is further configured to:

determine whether the first piston is located at its bottom dead center in response to a signal indicating that a battery pack has been mounted onto the driving tool, and cause the first piston to be moved to its bottom dead center when it has determined that the first piston is not located at its bottom dead center.

12. The electro-pneumatic driving tool according to claim 11, wherein the controller is further configured to move the first piston to its bottom dead center such that air inside the first cylinder is not compressed.

13. A method for operating a driving tool that comprises a first cylinder, a first piston slidably housed within the first cylinder, a drive mechanism configured to reciprocally move the first piston in the first cylinder between a bottom dead center and a top dead center, a second cylinder in fluid communication with the first cylinder via a fluid communication path, a second piston slidably housed within the second cylinder, a valve member movably disposed in the fluid communication path and configured to selectively block and permit fluid communication between the second cylinder and the first cylinder, and a sensor configured to directly or indirectly detect a position of the first piston, the method comprising:

generating compressed air in the first cylinder by sliding the first piston towards its top dead center while the valve member is blocking fluid communication between the second cylinder and the first cylinder;

moving the second piston by opening the valve member and supplying the compressed air inside the first cylinder into the second cylinder, whereby the driven article is forcibly driven out of an ejection port of the driving tool;

determining the position of the first piston, after it has come to a stop, based upon a signal from the sensor; and in response to a determination that the first piston is not stopped at its top dead center and is not stopped at its bottom dead center, performing a return operation, prior to the start of a driving operation of the driven article, to move the first piston to its bottom dead center.

14. The method according to claim 13, wherein the drive mechanism comprises a motor having a rotary shaft and a crank member driven by the rotary shaft; and the method further comprises:

directly detecting a rotational position of a rotary shaft or a rotational position of the crank member using the sensor to determine the position of the first position.

15. The method according to claim 13, wherein the return operation is started simultaneously with the direct or indirect detection of the position of the first piston by the sensor.

16. The method according to claim 13, wherein the driving tool further comprises a trigger configured to control operation of the drive mechanism and the driving tool is further configured to operate according to a single-shot driving mode, in which one of the driven articles is driven out of the ejection port with every single operation of the trigger, and according to a continuous driving mode, in which a plurality of the driven articles is driven out of the ejection port in the state in which the trigger is operated once; and the method further comprises:

performing the return operation, prior to starting the initial driving operation in the continuous driving mode and prior to starting the driving operation in the single-shot driving mode, when the sensor directly or indirectly detects that the first piston is not located at its bottom dead center.

17. The method according to claim 13, further comprising:

performing the return operation when a battery pack is mounted onto a battery-mounting part of the driving tool.

18. The method according to claim 13, wherein, in the return operation, the first piston is moved to its bottom dead center such that air inside the first cylinder is not compressed.

19. The method according to claim 18, wherein, in the return operation, the drive mechanism is driven in a reverse direction to move the first piston to its bottom dead center when the sensor directly or indirectly detects that the first piston come to a stop past its bottom dead center and is located on its way to its top dead center, such that the first piston does not pass through its top dead center during the return operation.

20. The method according to claim 13, further comprising communicating to a user that the return operation is being performed.

* * * * *